United States Patent [19]

Ueyama

[11] Patent Number: 4,688,057

[45] Date of Patent: Aug. 18, 1987

[54] HEAT-SENSITIVE TRANSFERRING RECORDING MEDIUM

[75] Inventor: Seiji Ueyama, Hirakata, Japan

[73] Assignee: General Company Limited, Osaka, Japan

[21] Appl. No.: 759,855

[22] Filed: Jul. 29, 1985

[30] Foreign Application Priority Data

Jul. 1, 1985 [JP] Japan ..... 60-144204

[51] Int. Cl.[4] ..... B41M 5/18

[52] U.S. Cl. ..... 503/204; 503/200; 427/152; 428/484; 428/488.4; 428/913; 428/914

[58] Field of Search ..... 346/204, 226, 200; 428/484, 488.1, 488.4, 913, 914, 195, 207, 211; 427/150–152

[56] References Cited

U.S. PATENT DOCUMENTS 3,035,936 5/1962 Roulston ..... 428/488.4
3,944,695 3/1976 Kosaka et al. ..... 428/497
4,315,643 2/1982 Tokonaga et al. ..... 428/484

FOREIGN PATENT DOCUMENTS 0054598 3/1984 Japan ..... 428/488.1

*Primary Examiner*—Bruce H. Hess
*Attorney, Agent, or Firm*—Wegner & Bretschneider

[57] ABSTRACT

A heat-sensitive transferring recording medium comprises a substrate, a heat-sensitive color forming layer on one side of the substrate, and a heat-sensitive transferring ink layer, on the other side of the substrate, consisting essentially of (a) a wax having penetration of not higher than 5 at 25° C., and acid value of 50–70, (b) a wax having penetration of not higher that 5 at 25° C. and saponification value of 70–90, (c) a wax having penetration of 7–20 at 25° C. (d) an extender pigment and (e) a coloring agent, and the contents of components (a)+(b), (c) and (d) in the solid matter of the heat-sensitive transferring ink are 20–40%, 20–40% and 20–30% by weight.

1 Claim, No Drawings

HEAT-SENSITIVE TRANSFERRING RECORDING MEDIUM

BACKGROUND OF THE INVENTION

1. Field of the Invention

This invention relates to a heat-sensitive transferring recording medium capable of producing two sheets of records when used in a heat-sensitive transferring recording medium such as thermal facsimile, thermal printer and the like, in such a manner that a sheet constituted of a substrate, a heat-sensitive color forming layer on one side of the substrate and a heat-sensitive transferring ink layer on the other side of the substrate is overlaid on a receiving sheet composed of plain paper to bring the heat-sensitive transferring ink layer into contact with the plain paper.

2. Description of the Prior Art

In such two-sheet recording type, the substrate is thicker than that for one-sheet recording type so that the degree of heat transmission is poor resulting in poor clearness of printed letters. In order to solve the problems, Japanese Patent Application Laid-open No. 24644/1979 proposes to incorporate a material of good heat conductivity in the substrate, and Japanese Patent Application Laid-open No. 75894/1981 proposes to incorporate a material of good conductivity in the heat-sensitive transferring ink. However, there are not yet obtained record of satisfactory clearness of printed letters.

SUMMARY OF THE INVENTION

An object of the present invention is to provide a heat-sensitive transferring recording medium capable of producing clear printed images of high density and free from smudge.

According to the present invention, there is provided a heat-sensitive transferring recording medium which comprises a substrate, a heat-sensitive color forming layer on one side of the substrate, and a heat-sensitive transferring ink layer, on the other side of the substrate, consisting essentially of (a) a wax having penetration (JIS K 2235) of not higher than 5 at 25° C. and acid value of 50–70, (b) a wax having penetration (JIS K 2235) of not higher than 5 at 25° C. and saponification value of 70–90, (c) a wax having penetration (JIS K 2235) of 7–20 at 25° C., (d) an extender pigment and (e) a coloring agent, and the contents of components (a)–(d) in the solid matter of the heat-sensitive transferring ink are preferably as follows:

| | |
|---|---|
| Total of components (a) and (b) | 20–40% by weight |
| Component (c) | 20–40% by weight |
| Component (d) | 20–30% by weight |

DESCRIPTION OF THE PREFERRED EMBODIMENTS

In case that acid value and saponification value are outside of the range of the present invention, density of printed images is irregular and clearness of printed images is poor.

In case where acid value and saponification value are within the range of the present invention, but the amount of the extender pigment is outside of the range, the density of printed images are not irregular, but clearness of printed images is poor and sharp printed images are not obtained and, in addition, smudge is formed.

As the waxes used in the present invention there may be mentioned waxes which are usually used for heat-sensitive transferring recording mediums, such as carnauba wax, montan wax, oxidized wax, paraffin wax, microcrystalline wax, low molecular weight polyethylene wax and the like, as far as they satisfy the conditions of the present invention.

As the extender pigment, there may be used calcium carbonate, clay, barium sulfate, talc and the like, and calcium carbonate is preferable.

As the coloring agent, there may be used coloring agents which are usually used for heat-sensitive transferring recording mediums.

If desired, a softening agent may be added. As the softening agent, various oils such as vegetable oil, animal oil, mineral oil and the like may be used.

As the heat-sensitive color forming layer, conventional one may be used. For example, there are used heat-sensitive color forming compositions composed of a colorless dye such as lactone series dyes (e.g. Crystal Violet Lactone), lactam series dyes, fluoran series dyes, spiropyrane series dyes and the like, a color forming agent such as phenyl compounds (e.g. bisphenol A), organic acids or salts thereof and the like, and a binder such as PVA, CMC, methyl cellulose, hydroxyethylcellulose, casein, starch and the like. If desired, an auxiliary agent such as clay, talc and the like, is added.

EXAMPLE

To the back surface of a heat-sensitive color forming paper was applied an ink as shown in the table below (the amount being "parts by weight"). The resulting heat-sensitive transferring recording medium was used to form printed letters on a high grade paper as a receiving paper by using Handy Terminal HT-3000 (tradename, manufactured by Canon K.K.).

The results are shown in the following table.

| | | 1 | 2 | 3 | 4 | 5 | 6 | 7 | 8 | 9 | 10 | 11 | 12 | 13 |
|---|---|---|---|---|---|---|---|---|---|---|---|---|---|---|
| Formula | Carnauba<br>Penetration: <1<br>Saponification value: 85 | 10 | 5 | 10 | 15 | 15 | 10 | 20 | 20 | 20 | 0 | 30 | 25 | 30 |
| | Oxidized wax<br>Penetration: 5<br>Acid value: 60 | 0 | 5 | 10 | 15 | 15 | 20 | 20 | 20 | 20 | 30 | 0 | 25 | 10 |
| | Paraffin<br>Penetration: 10 | 50 | 50 | 40 | 30 | 20 | 30 | 40 | 20 | 40 | 30 | 30 | 25 | 10 |
| | Extender pigment | 30 | 30 | 30 | 30 | 40 | 30 | 10 | 30 | 0 | 30 | 30 | 15 | 40 |
| | Coloring agent | 8 | 8 | 8 | 8 | 8 | 8 | 8 | 8 | 18 | 8 | 8 | 8 | 8 |
| | Softening agent | 2 | 2 | 2 | 2 | 2 | 2 | 2 | 2 | 2 | 2 | 2 | 2 | 2 |
| Evaluation | Density | X | X | O | O | O | O | O | O | O | X | X | Δ | X |

-continued

| | 1 | 2 | 3 | 4 | 5 | 6 | 7 | 8 | 9 | 10 | 11 | 12 | 13 |
|---|---|---|---|---|---|---|---|---|---|---|---|---|---|
| Clearness of printed images | X | X | O | O | O | O | Δ | O | X | X | X | Δ | X |
| Smudge | X | X | O | O | Δ | O | Δ | O | Δ | X | X | Δ | X |
| Overall evaluation | X | X | O | O | Δ | O | Δ | O | X | X | X | Δ | X |

O: Good
Δ: Practically not usable
X: Not usable

Simply mixing two or more waxes can not attain the advantages of the present invention, and further the amounts of the waxes and the extender pigment should satisfy the conditions of the present invention to achieve the effect of the present invention.

What is claimed is:

1. A heat-sensitive transferring recording medium which comprises a substrate, a heat-sensitive color forming layer on one side of the substrate, and a heat-sensitive transferring ink layer, on the other side of the substrate, consisting essentially of (a) a wax having penetration (JIS K 2235) of not higher than 5 at 25° C. and acid value of 50–70, (b) a wax having penetration (JIS K 2235) of not higher than 5 at 25° C. and saponification value of 70–90 (c) a wax having penetration (JIS K 2235) of 7–20 at 25° C., (d) an extender pigment and (e) a coloring agent, the solid matter of the heat-sensitive transferring ink containing 20–40% by weight of the sum of the components (a) and (b), 20–40% by weight of the component (c) and 20–30% by weight of the component (d).

* * * * *